United States Patent [19]

Rosén

[11] 3,931,939

[45] Jan. 13, 1976

[54] THREAD SUPPLY DEVICE FOR TEXTILE MACHINES

[75] Inventor: Karl Isac Joel Rosén, Hjo, Sweden

[73] Assignee: Aktiebolaget IRO, Ulricehamn, Sweden

[22] Filed: Mar. 8, 1974

[21] Appl. No.: 449,260

[30] Foreign Application Priority Data

Mar. 15, 1973 Germany ..... 2312933

[52] U.S. Cl. ..... 242/47.01; 66/132 R

[51] Int. Cl.[2] ..... B65H 51/20

[58] Field of Search ..... 242/47.01–47.13; 66/132 R; 139/122 R

[56] References Cited

UNITED STATES PATENTS

| | | | |
|---|---|---|---|
| 3,709,444 | 1/1973 | Tannert | 242/47.12 X |
| 3,782,661 | 1/1974 | Deniega et al. | 242/47.12 |
| 3,796,386 | 3/1974 | Tannert | 242/47.12 |

*Primary Examiner*—Stanley N. Gilreath

*Attorney, Agent, or Firm*—Woodhams, Blanchard and Flynn

[57] ABSTRACT

A thread supply device for a textile machine, in particular a knitting machine, having a thread drum upon which a thread issuing from a thread bobbin can be wound to form an intermediate thread supply and from which the thread can be unwound at an unwinding speed equal to the speed of winding. A winding shaft is set in rotation by a driving means in order to wind the thread up onto the thread drum. The driving means engages the winding shaft via a clutch which can be released when the driving means is at a standstill. The winding shaft is provided with a connection member for engaging an auxiliary driving means for setting the winding shaft in rotation when the clutch is disengaged.

7 Claims, 3 Drawing Figures

THREAD SUPPLY DEVICE FOR TEXTILE MACHINES

Figure 1:
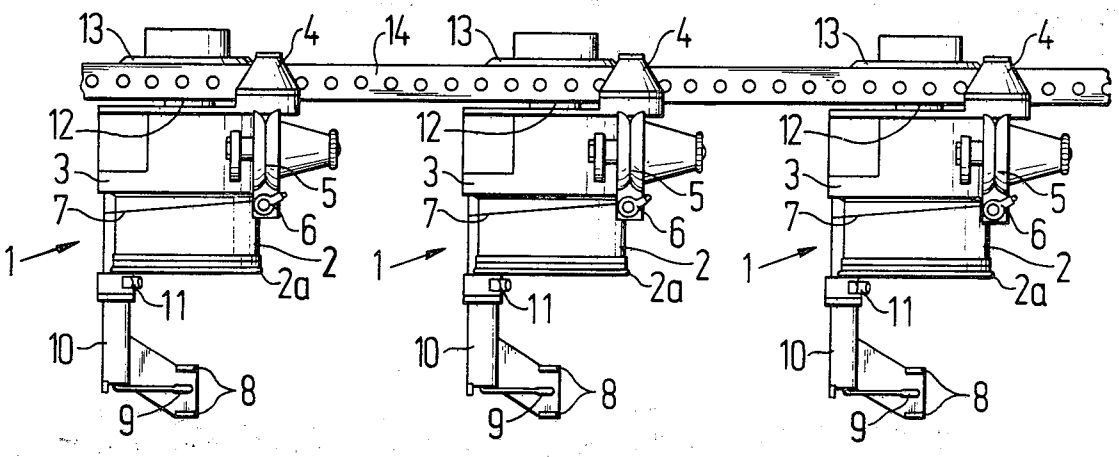

This invention relates to a thread supply device for textile machines, in particular for knitting machines, comprising a thread drum, upon which a thread issuing from a thread bobbin can be wound to form an intermediate thread supply and from which the thread can be unwound at a withdrawal speed equal to the speed of winding, a winding shaft being set in rotation by means of a drive means in order to winding the thread up onto said thread drum.

Thread supply devices of this kind are intended for what is termed positive thread supply in which the textile machine is supplied with an amount of thread which is always constant.

Up to now it was conventional to manually wind the intermediate thread supply onto the thread drum when the thread supply device was first put into operation. When the textile machine and consequently the thread supply device was stopped due to a break in the thread between the supply bobbin and the thread supply device, the intermediate thread supply on the thread supply device was reduced because no thread was wound onto the thread drum from the time the thread broke until the machine came to a standstill, but at the same time thread was nevertheless withdrawn from the drum, thereby exhausting the intermediate thread supply as the number of breaks and accompanying shutdowns of the machine increase. The intermediate thread supply must be supplemented again by manually winding thread onto the drum once again.

This invention is based on the object of developing a thread supply device of the kind described at the outset such that the intermediate thread supply may be formed and increased quickly and easily both at the beginning of operation and when thread depletion seems imminent.

This object is accomplished in accordance with the invention in that the driving means engages the winding shaft via a clutch which can be released when the driving means is at a standstill and that said winding shaft is provided with a connection member for engaging an auxiliary driving means for setting the winding shaft in rotation when the clutch is disengaged.

In the case of the inventive thread supply device, the driving means may be separated from the winding shaft by engaging the clutch. By providing an auxiliary driving means on the winding shaft, the thread drum or a winding element associated herewith can be set in rotation independently of the actual driving means so that the intermediate thread storage may be formed or supplemented quickly and without difficulty.

The auxiliary driving means may be either a manual crank which is especially simple or a transportable motor whose motor shaft can be coupled to the winding shaft via the connection member. In the latter case, the intermediate storage can be formed or supplemented very quickly.

Figure 3:
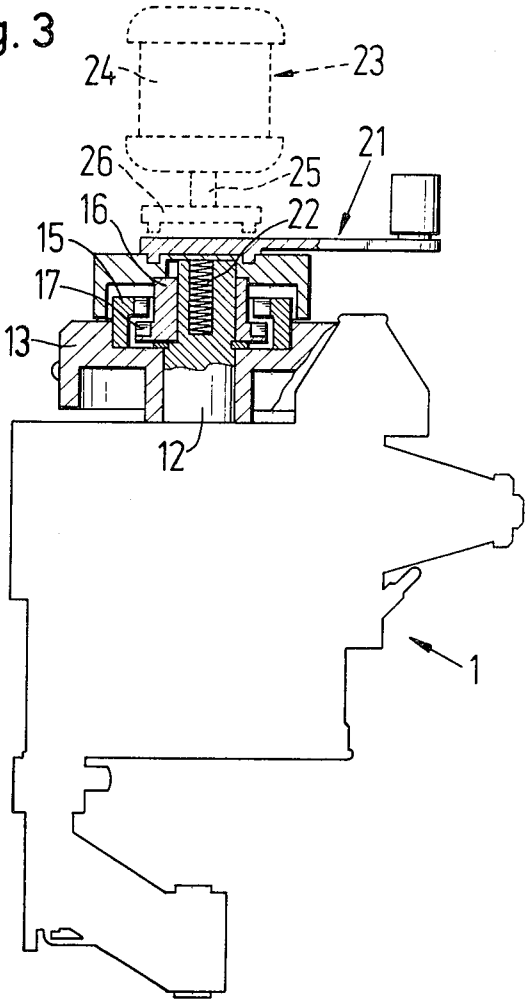
Figure 2:
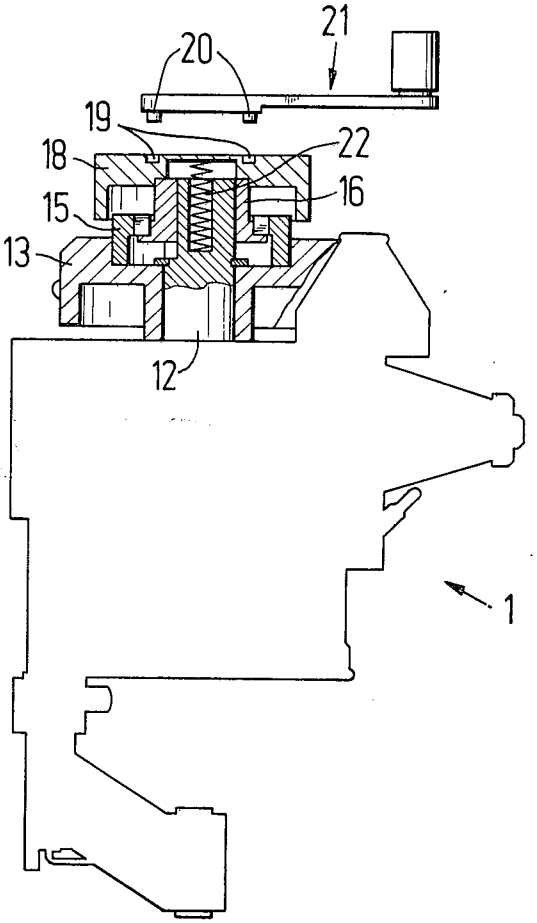

One embodiment of the invention is illustrated in the drawing in which:

FIG. 1 shows a plurality of mutually driven thread supply devices according to the invention in schematic side elevation, FIG. 2 shows a side elevation of a single inventive thread supply device whose unimportant parts are only indicated in outline form while the parts essential to the invention are illustrated in a longitudinal section in normal operative position, and FIG. 3 is an illustration corresponding to FIG. 2 in which the parts are located in the position required to form or supplement the intermediate thread storage.

In the drawing, 1 indicates thread supply devices which are mounted on a knitting machine, for example, such that a thread supply device is associated with every knitting system.

Each thread supply device 1 includes a thread drum 2 which is rotatably journaled in a stationary housing 3. The thread issuing from a storage bobbin (not shown) passes through a guide means 4 and a main brake 5 as well as a thread monitor 6 and is wound tangentially upon the rotating thread drum 2. A displacement ring which is inclined relative to the axis of the drum and which is illustrated at 7 displaces the thread windings axially along the thread drum 2 so that an intermediate thread storage is formed on said drum. The thread is unwound from this intermediate storage over the withdrawal rim 2*a* of the drum and is supplied to the knitting machine through a withdrawal eye 8, which is coaxial to the axis of the drum, and another thread monitor 9. An arm 10 supporting the parts 8 and 9 is also provided with a hook 11 which is rotatably journaled and which is normally pivoted into a position in which it prevents lateral displacement of the thread which unwinds from the thread drum 2 in a downward direction. This ensures that the speed of unwinding of the thread is limited to the speed of winding. The hook 11 can also be pivoted away so that the thread can then be freely withdrawn in a downward direction. This is of particular interest when the textile machine has to be adjusted or repaired when the thread consumption may vary somewhat. When the hook 11 is pivoted away, one can then see why the thread consumption varies although the thread supply device and the machine operate synchronously.

The thread drum 2 is driven via a winding shaft 12 which has a belt pulley 13 with pins mounted thereupon. The belt pulleys of all thread supply devices associated with a textile machine are encompassed by a common perforated drive belt 14 which in turn is driven by a central driving means, i.e., by the driving means of the textile machine itself.

As FIGS. 2 and 3 illustrate in fuller detail, the belt pulley 13 is rotatably mounted on the winding shaft 12. A first annular clutch member 15 is force-fitted into a recess in the upper side of the pulley 13.

At the upper end of the winding shaft 12, there is mounted a sleeve 16 which is nonrotatably connected to shaft 12 but is axially movable therealong. Sleeve 16 includes on the outside a second clutch member 17 which matches said first clutch member 15. The sleeve 16 is maintained in a cover part 18 in force fit, said cover part serving to cover the top of parts 15 to 17. The cover part includes a pair of recesses 19 in its surface which are adapted to receive pins 20 of a manual crank 21. The cover part 18 together with the sleeve 16 is displaced or urged upwardly by a compression spring 22 which is disposed in a blind hole in the winding shaft 12.

In the normal operative position according to FIG. 2, the spring 22 urges the cover part 18 and the sleeve 16 upwardly so far that the toothed clutch parts 15 and 17 mesh. Rotations of the belt pulley 13 caused by the belt 14 are therefore transmitted to the winding shaft 12 and set the thread drum 2 in rotation.

At the beginning of the operation when there is no thread wound on the thread drum 2 or when the driving means of the thread drum 2 is at a standstill due to a break in the thread and the intermediate thread storage is nearing depletion, it is desirable to be able to set the thread drum 2 in rotation independently of the driving means. To this end, the manual crank 21 is inserted so that the pins 20 engage the recesses 19 in the cover part 18 and the cover part 18 is pressed downwardly against the force of the spring 22, thereby forcing the parts into the position shown in FIG. 3. As can be seen, the toothed clutch parts 15 and 17 are disengaged. By turning the crank 21 the winding shaft 12 can be rotated independently of the common driving means and thread can be wound onto the thread drum. If the thread storage merely needs to be filled up without a break having occurred in the thread between the respective thread supply device and the knitting machine, the hook 11 is pivoted out of the path of the unwinding thread so that the rotation of the thread drum 12 only winds up thread without removing thread at the bottom.

This invention is not limited to the embodiment illustrated in the drawing. In particular, any arbitrary disengagable clutch may be provided between the belt pulley 13 and the winding shaft 12 and may be released by means of an auxiliary driving means. Moreover, an auxiliary drive motor could also be provided instead of a manual crank 21 as is illustrated by the dotted lines at 23 in FIG. 3. The auxiliary drive motor 23 includes an electromotor 24 which may be battery-driven for example and which has a pin wheel 26 mounted on the motor shaft 25. The pins of the pin wheel correspond to the pins 20 of the manual crank 21 and match the recesses 19 in the cover part 18.

This invention may also be used in the case of such thread supply devices which have a stationary thread drum. In this case, a thread winding device is conducted around the stationary thread drum by means of a winding shaft. This winding shaft corresponds to the winding shaft 12 of the embodiment described.

What is claimed is:

1. In a positive thread supply device for a textile machine, particularly a knitting machine, having thread drum means upon which a thread issuing from a thread bobbin can be wound to form an intermediate thread supply and from which the thread can be unwound at an unwinding speed substantially equal to the winding speed to permit positive thread supply to a textile machine, rotatable winding shaft means for causing thread to be wound on said drum means when said shaft means is rotated, and drive means drivingly interconnected to said shaft means for causing rotation thereof, comprising the improvement wherein clutch means drivingly connects said drive means to said shaft means to permit positive thread supply, said clutch means being maintained in an engaged position when said drive means is activated to permit thread to be wound on said drum means at a speed substantially equal to the speed at which the thread is also being unwound from said drum means, said clutch means being releasable to disconnect said winding shaft means from said drive means when the latter is at a standstill, said clutch means including a first clutch part drivingly connected to said drive means and a second clutch part drivingly connected to said winding shaft means, said first and second clutch parts being normally maintained in engagement but being relatively movable away from one another to permit clutch disengagement, and connecting means adapted for engagement with an auxiliary driving means to permit selective rotation of said shaft means when said clutch means is disengaged so that the intermediate thread supply on said drum means can be replenished, said connecting means including means associated with said clutch means and engageable with said auxiliary driving means for causing (1) relative movement between said clutch parts into a position of clutch disengagement and (2) rotation of said second clutch part independently of said first clutch part to selectively rotate said shaft means upon rotation of said auxiliary driving means.

2. A thread supply device according to claim 1, wherein the means associated with said clutch means includes a connecting member nonrotatably connected to said second clutch part, said connecting member having engaging means associated therewith for releasable engagement with said auxiliary driving means to permit controlled rotation of said second clutch part by said auxiliary driving means independently of said first clutch part.

3. A thread supply device according to claim 2, wherein said second clutch part, when engaged with said auxiliary driving means, is moved into a position of clutch disengagement.

4. In a positive thread supply device for a textile machine, particularly a knitting machine, having thread drum means upon which a thread issuing from a thread bobbin can be wound to form an intermediate thread supply and from which the thread can be unwound at an unwinding speed substantially equal to the winding speed to permit positive thread supply to a textile machine, rotatable winding shaft means for causing thread to be wound on said drum means when said shaft means is rotated, and drive means drivingly interconnected to said shaft means for causing rotation thereof, comprising the improvement wherein said drive means includes a rotatable drive wheel rotatably supported on said winding shaft means, and clutch means drivingly connecting said drive wheel to said shaft means to permit positive thread supply, said clutch means being maintained in an engaged position when said drive means is activated to permit thread to be wound on said drum means at a speed substantially equal to the speed at which the thread is also being unwound from said drum means, said clutch means being releasable to disconnect said winding shaft means from said drive wheel when the latter is at a standstill, said clutch means including a first clutch part nonrotatably connected to said drive wheel and a second clutch part nonrotatably connected to said winding shaft means, said first and second clutch parts being relatively axially movable toward and away from one another to permit clutch engagement and disengagement respectively, said second clutch part being mounted for axial movement with respect to said winding shaft means, means coacting with said second clutch part for normally urging same into engagement with said first clutch part, and connecting means associated with said shaft means and adapted for engagement with an auxiliary driving means to permit selective rotation of said shaft means when said clutch means is released so that the intermediate thread supply on said drum means can be replenished, said connecting means including a connecting member fixedly interconnected to said clutch part.

5. A thread supply device according to claim 4, including auxiliary driving means releasably engageable with said connecting member for permitting selective rotation of said winding shaft means, said auxiliary driving means including a removable hand crank.

6. A thread supply device according to claim 4, including auxiliary driving means releasably engageable with said connecting member for permitting selective rotation of said winding shaft means, said auxiliary driving means including a transportable motor having a rotatable motor shaft and a drive element connected to said motor shaft and releasably engageable with said connecting member.

7. In a positive thread supply device for a textile machine, particularly a knitting machine, having rotatable thread drum means upon which a thread issuing from a thread bobbin can be tangentially wound to form an intermediate thread supply and from which the thread can be unwound from the drum at an unwinding speed substantially equal to the winding speed to permit positive thread supply to a textile machine, and drive means drivingly interconnected to said drum means for causing rotation thereof, said drive means including a rotatable drive wheel and a driving member engaged with said drive wheel, said driving member being driven from the main drive of a textile machine when said textile machine is in operation, comprising the improvement wherein clutch means drivingly connects said drive means to said drum means to permit positive thread supply, means coacting with said clutch means for normally maintaining said clutch means in an engaged position at least when said drive means is activated so that said drum means is rotated to permit thread to be wound on said drum means at a speed substantially equal to the speed at which the thread is also being unwound from said drum means, said clutch means being releasable to disconnect said drum means from said drive means when the latter is at a standstill, said clutch means including a first clutch element associated with said drive wheel for rotation therewith and a second clutch element associated with said drum means for rotation therewith, said first and second clutch elements being relatively movable and normally maintained in an engaged position whenever the textile machine is in operation, and connecting means associated with said drum means and adapted for engagement with an auxiliary driving means to permit selective rotation of said drum means when said clutch means is released so that the intermediate thread supply on said drum means can be replenished, said connecting means including means associated with said clutch means and engageable with said auxiliary driving means for causing (1) relative movement between said clutch elements into a position of clutch disengagement and (2) rotation of said second clutch element independently of said first clutch element to selectively rotate said drum means upon rotation of said auxiliary driving means.

* * * * *